US008439550B2

(12) United States Patent
Sohn

(10) Patent No.: US 8,439,550 B2
(45) Date of Patent: May 14, 2013

(54) FRAME CONNECTING MEMBER AND LIGHT EMITTING DIODE LIGHTING APPARATUS FABRICATED BY USING THE SAME

(75) Inventor: Choong Yong Sohn, Chungbuk (KR)

(73) Assignee: Galaxia Electronics Co., Ltd. (KR)

( * ) Notice: Subject to any disclaimer, the term of this patent is extended or adjusted under 35 U.S.C. 154(b) by 208 days.

(21) Appl. No.: 12/755,408

(22) Filed: Apr. 6, 2010

(65) Prior Publication Data

US 2010/0265722 A1 Oct. 21, 2010

(30) Foreign Application Priority Data

Apr. 21, 2009 (KR) ..... 10-2009-0034538

(51) Int. Cl.
*F21V 7/04* (2006.01)

(52) U.S. Cl.
USPC ..... 362/633; 362/632; 362/634; 349/58

(58) Field of Classification Search ..... 362/217.1, 362/217.11–217.13, 97.1–97.4, 632–634; 349/58
See application file for complete search history.

(56) References Cited

U.S. PATENT DOCUMENTS

| | | | | |
|---|---|---|---|---|
| 7,142,264 | B2 * | 11/2006 | Choi et al. | 349/58 |
| 7,665,879 | B2 * | 2/2010 | Hsieh | 362/633 |
| 2008/0018825 | A1 * | 1/2008 | Lee et al. | 349/58 |
| 2008/0143918 | A1 * | 6/2008 | Kim | 349/58 |
| 2009/0196034 | A1 * | 8/2009 | Gherardini et al. | 362/235 |

FOREIGN PATENT DOCUMENTS

KR 0891164 3/2009

OTHER PUBLICATIONS

English language translation of the Abstract of KR 0891164.

* cited by examiner

*Primary Examiner* — Robert May
(74) *Attorney, Agent, or Firm* — Cantor Colburn LLP

(57) ABSTRACT

Provided is a frame connecting member for connecting a plurality of frame members to provide a frame of a lighting apparatus. The frame connecting member includes a body, an engaging unit connected to the body, the engaging unit being configured to be coupled to the plurality of the frame members, respectively, and a light leakage prevention unit connected to the body, the light leakage prevention unit being configured to prevent a light emitted from the lighting apparatus from leaking.

16 Claims, 6 Drawing Sheets

FRAME CONNECTING MEMBER AND LIGHT EMITTING DIODE LIGHTING APPARATUS FABRICATED BY USING THE SAME

BACKGROUND OF THE INVENTION

1. Field of the Invention

The present invention relates to a frame connecting member and a light emitting diode (LED) lighting apparatus fabricated by using the same.

2. Description of the Related Art

A various kinds of lighting apparatus are used to provide a light or illuminate an object in an indoor or outdoor environment. The lighting apparatus is supplied with a power and converts an electric energy of the power to a light energy. Thus, a light is irradiated to an object by the lighting apparatus. In general, an incandescent lamp or a fluorescent lamp is used in the lighting apparatus.

The incandescent lamp or the fluorescent lamp has some disadvantages in that the incandescent lamp or the fluorescent lamp has a higher power consumption and produces heat. Also, the incandescent lamp or the fluorescent lamp has a relatively short life cycle so that the incandescent lamp or the fluorescent lamp needs to be replaced in approximately every six months. Moreover, in case of the fluorescent lamp which contains mercury, the use of the fluorescent lamp is restricted and required to be complied with certain regulations. Also, since the fluorescent lamp flickers, the eye is caused to feel fatigue easily, which weakens a user's eye sight. Further, the fluorescent lamp requires a large installation space and the installation and color control thereof is difficult.

To solve the above problem, a lighting apparatus using a light emitted diode (LED) as a light source has been introduced. The LED lighting apparatus includes a substrate on which the LED light source is mounted and a diffusion plate that is arranged parallel to the substrate. The substrate and the diffusion plate are received within a frame that can be formed in various materials such as metal, wood or plastic to provide a single apparatus.

However, in the conventional lighting apparatus frame, a light can leak out from an edge portion, which is a joint area between the frame members. Also, a structural problem can be caused such as, for example, the bonding between the frame members becomes weak during usage, the frame member becomes detached from the lighting apparatus frame, or the joint area between the frame members becomes distorted due to mismatch.

The above information disclosed in this Background section is retained or acquired by the inventor in an effort to realize the object of the invention, and therefore it may contain information that does not form the prior art that is already known to the public.

SUMMARY OF THE INVENTION

The present invention has been made in view of the above problems, and provides a frame connecting member and a light emitting diode (LED) lighting apparatus assembled by using the frame connecting member, in which a light leakage from a lighting apparatus frame is prevented and frame members are tightly fastened to each other to provide a secure, structured frame.

In accordance with an aspect of the present invention, a frame connecting member for connecting a plurality of frame members to provide a frame of a lighting apparatus, the frame connecting member includes: a body; an engaging unit connected to the body, the engaging unit being configured to be coupled to the plurality of the frame members, respectively; and a light leakage prevention unit connected to the body, the light leakage prevention unit being configured to prevent a light emitted from the lighting apparatus from leaking.

In accordance with another aspect of the present invention, a light emitting diode (LED) lighting apparatus includes: a light source module; a lighting plate configured to be positioned spaced apart from the light source module by a predetermined distance; a frame member including a first groove for receiving the lighting plate and a second groove for receiving the light source module, wherein a plurality of the frame members are connected to one another to provide a lighting apparatus frame that receives the lighting plate and the light source module therein; a body; an engaging unit connected to the body, the engaging unit being configured to be coupled to the plurality of the frame members, respectively; and a light leakage prevention unit connected to the body, the light leakage prevention unit being configured to prevent a light emitted from the lighting apparatus from leaking.

In one example embodiment, the body may be configured to be coupled to an edge portion positioned in a location where the plurality of the frame members contact each other and may be configured to have a shape such that the body is matched with the edge portion to shield a light leaking from the edge portion In one example embodiment, the engaging unit may have a shape of an engaging wing that extends from at least one of a first side and a second side of the body. In this case, a trench may be provided on the frame member and the engaging wing may be configured to have a shape such that the engaging wing matches with the trench. The engaging wing may be configured to have a certain thickness such that a screw hole is positioned thereon, and the engaging wing is coupled to the frame member by using a screw that penetrates the frame member to engage with the screw hole.

In one example embodiment, a first groove may be positioned on an inner surface of the frame member to receive a lighting plate and the light leakage prevention unit may be formed as a lighting plate insertion groove to receive a part of the lighting plate. The lighting plate may be a diffuser or a protector and the lighting plate insertion groove may have an entrance portion that is chamfered to facilitate an insertion of the lighting plate to the lighting plate insertion groove.

In one example embodiment, a light source module may be mounted within the frame, the light source module being spaced apart from the lighting plate by a predetermined distance, and a supporting unit may be provided in the body to support the light source module, the supporting unit being positioned in correspondence with the light source module. A second groove may be positioned on each of the plurality of the frame members to receive the light source module, and the supporting unit may be configured to be inserted to the second groove. In this case, a trench having a certain shape that matches with the engaging unit may be positioned on the frame member and the trench may be configured to be provided by forming the first groove and the second groove, the trench being positioned between the first groove and the second groove.

In one example embodiment, the light source module may be a substrate on which a light emitted diode (LED) light source is mounted or a light guide plate having a side surface on which the LED light source is positioned. The body, the engaging unit and the light leakage prevention unit may be integrally formed with one another by using a die casting method.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein. Accordingly, example embodiments are to cover all modifications, equivalents, and alternatives falling within the scope of the invention.

It will be understood that, although the terms first, second, etc. may be used herein to describe various elements, these elements should not be limited by these terms. These terms are only used to distinguish one element from another.

It will be understood that, when a feature or element is referred to as being "connected" or "coupled" to another feature or element, it can be directly connected or coupled to the other element or intervening elements may be present. In contrast, when a feature or element is referred to as being "directly connected" or "directly coupled" to another element, there are no intervening elements present.

The terminology used herein is for the purpose of describing particular embodiments only and is not intended to be limiting of example embodiments of the invention. It will be understood that the terms "comprises," or "includes," when used herein, specify the presence of stated features, integers, steps, operations, elements, and/or components, but do not preclude the presence or addition of one or more other features, integers, steps, operations, elements, components, and/or groups thereof.

Like numbers are used throughout the drawings to refer to the same or like parts and a repetitive explanation will be omitted. Detailed descriptions of well-known functions and structures incorporated herein may be omitted to avoid obscuring the subject matter of the present invention.

Figure 1:
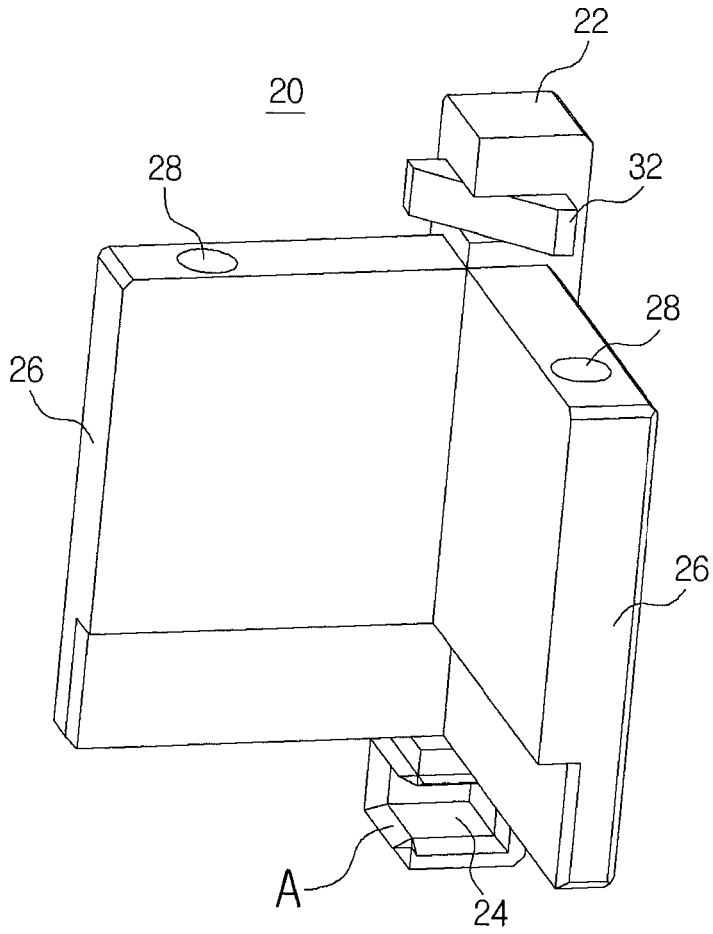
FIGS. 1 and 2 are perspective views illustrating a frame connecting member according to an example embodiment of the present invention.
Figure 2:
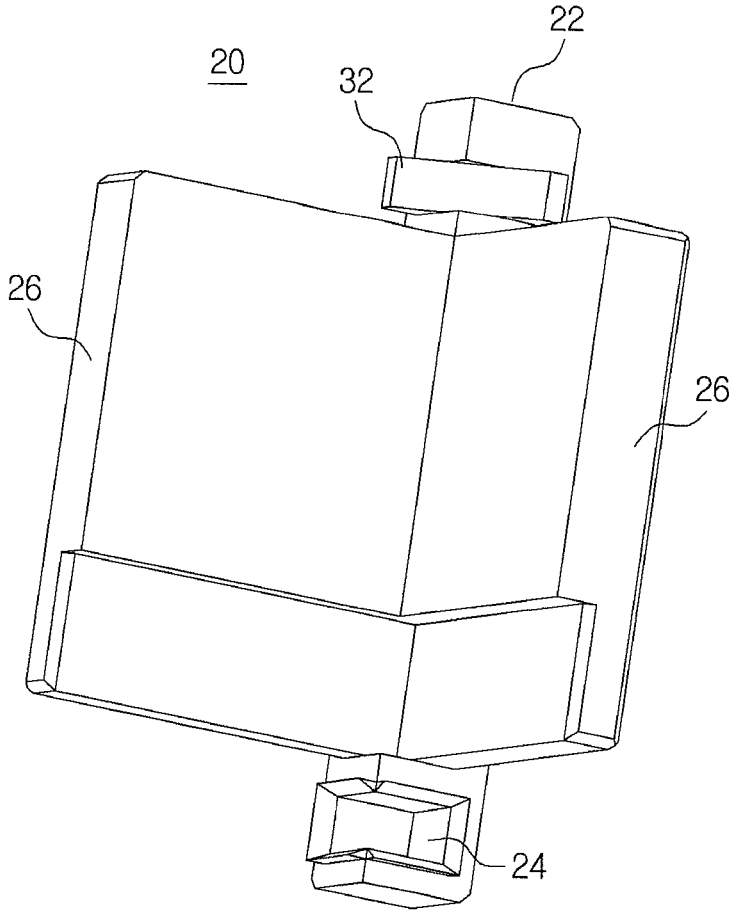

FIGS. 1 and 2 are perspective views illustrating a frame connecting member according to an example embodiment of the present invention;

Referring to FIGS. 1 and 2, a connecting member 20, a body 22, a lighting plate insertion groove 24, an engaging wing 26, a screw hole 28 and a supporting unit 32 are illustrated.

In this example embodiment, it is described a connecting member specially designed and manufactured for use in a lighting apparatus frame in which a light emitting diode (LED) is employed as a light source. The connecting member is positioned in a connecting area between a light source module and a frame member, wherein the connecting member has a groove formed therein to respectively receive the light source module and a lighting plate, which is arranged parallel to the light source module.

When the lighting apparatus has a direct type structure, a substrate, for example, a printed circuit board (PCB) on which an LED light source is mounted can be used as the light source module. When the lighting apparatus has a lateral type structure, a light guide plate having a side surface on which the LED light source is positioned can be used as the light source module. A reflector can be laminated on the PCB or the light guide plate to increase lighting efficiency.

In the direct type structure, a diffuser can be used in the lighting plate. Also, in the lateral type structure, a protector can be used in the lighting plate. The diffuser or the protector is provided to allow a light emitted from the light source module to be evenly irradiated without causing a glare.

The connecting member 20 is characterized in that the supporting unit 32 is formed in correspondence with the light source module and a light leakage preventing groove is formed in correspondence with the lighting plate so that a light emitted from the lighting apparatus may not leak through a joint between components of the frame. Also, according to the example embodiment, the light source module may be reliably supported and the frame members may be securely coupled to one another.

Namely, the connecting member 20 according to the example embodiment is used to connect a plurality of the frame members to one another to form a frame of a lighting apparatus. The connecting member 20 includes a body 22 configured to fill a gap between the plurality of the frame members and an engaging unit configured to respectively engage with the plurality of the frame members so that the frame members are connected to one another.

The body 22 shields a joint between the plurality of the frame members to prevent a light leakage. Also, the body 22 shields an edge of the lighting apparatus to improve aesthetic appearance of the lighting apparatus.

The engaging unit may be formed as an engaging wing 26, which may be formed to extend from at least two sides of the body 22 as shown in FIGS. 1 and 2. Each of the engaging wings 26 may be coupled to the frame member so that two frame members can be connected with each other.

In FIGS. 1 and 2, it is described that an angle between two engaging wings 26 that respectively extend from the body 22 is substantially 90 degree. By adjusting the angle between the engaging wings 26, an angle at which the plurality of the frame members are connected to one another can be controlled. For example, as illustrated in FIGS. 3 through 6, when manufacturing the lighting apparatus in a rectangular shape, the angle between the engaging wings 26 can be 90 degree. When manufacturing the lighting apparatus in a hexagonal shape, the angle between the engaging wings 26 can be 120 degree.

In the lighting apparatus having the LED as a light source, a substrate on which the LED light source is mounted or a light guide plate having a side surface on which the LED light source is positioned can be used as a light source module. A lighting plate can be arranged to be spaced apart from the light source module by a predetermined interval so that a light emitted from the LED is diffused and irradiated in the lighting plate, thereby performing an effective lighting. Such lighting apparatus has a structure in which the light source module and the lighting plate are mounted within a frame that has a certain configuration.

The frame member is a member that is used to form the frame of the lighting apparatus by coupling with other frame members. An inner surface of the frame member may have a first groove or a second groove formed thereon to receive a structure such as the light source module or the lighting plate. For example, the lighting plate can be inserted into the first groove and the lighting module can be inserted into the second groove.

As shown in FIGS. 3 through 6, which will be described below, when the light source module or the lighting plate are formed in a rectangular shape, the first groove and the second groove positioned on the inner surface of the frame member may form a trench or lay a rail that extends in one direction so that an edge of the lighting module or the lighting plate can be coupled thereto.

The connecting member 20 according to this example embodiment serves as a connection structure for connecting the plurality of the frame members to one another. Also, the body 22 of the connecting member 20 may have a light leakage prevention unit formed thereon to reduce a light leakage from a joint between the frame members.

The light leakage prevention unit may be formed as the lighting plate insertion groove 24 formed on a part of the body 22 so that the lighting plate can be fixed therein. Namely, since the connecting member 20 is provided at a junction between the plurality of the frame members, when the lighting plate insertion groove 24 is formed on a part of the connecting member 20 so that the edge of the lighting plate can be inserted thereto, a light irradiated from the lighting plate may be prevented from leaking.

The connecting member 20 according to example embodiments may be formed in various materials such as plastic or metal. Also, the connecting member 20 can be manufactured in various methods such as a molding or die casting process. When the connecting member 20 is manufactured by the molding or die casting process, the body 22, the lighting plate insertion groove 24, and the engaging wing 26 can be integrally formed with one another. However, it should be noted that the connecting member may be formed in any material other than the above-mentioned material. Also, other various methods can be used to manufacture the connecting member 20. For example, each component of the connecting member 20 can be provided as a separate member to be assembled and coupled to one another.

FIGS. 3 through 6 illustrate a lighting apparatus, which is, for illustrative purposes, described as having a direct type structure in which a substrate on which the LED lighting source is mounted is utilized as a lighting source module.

Figure 3:
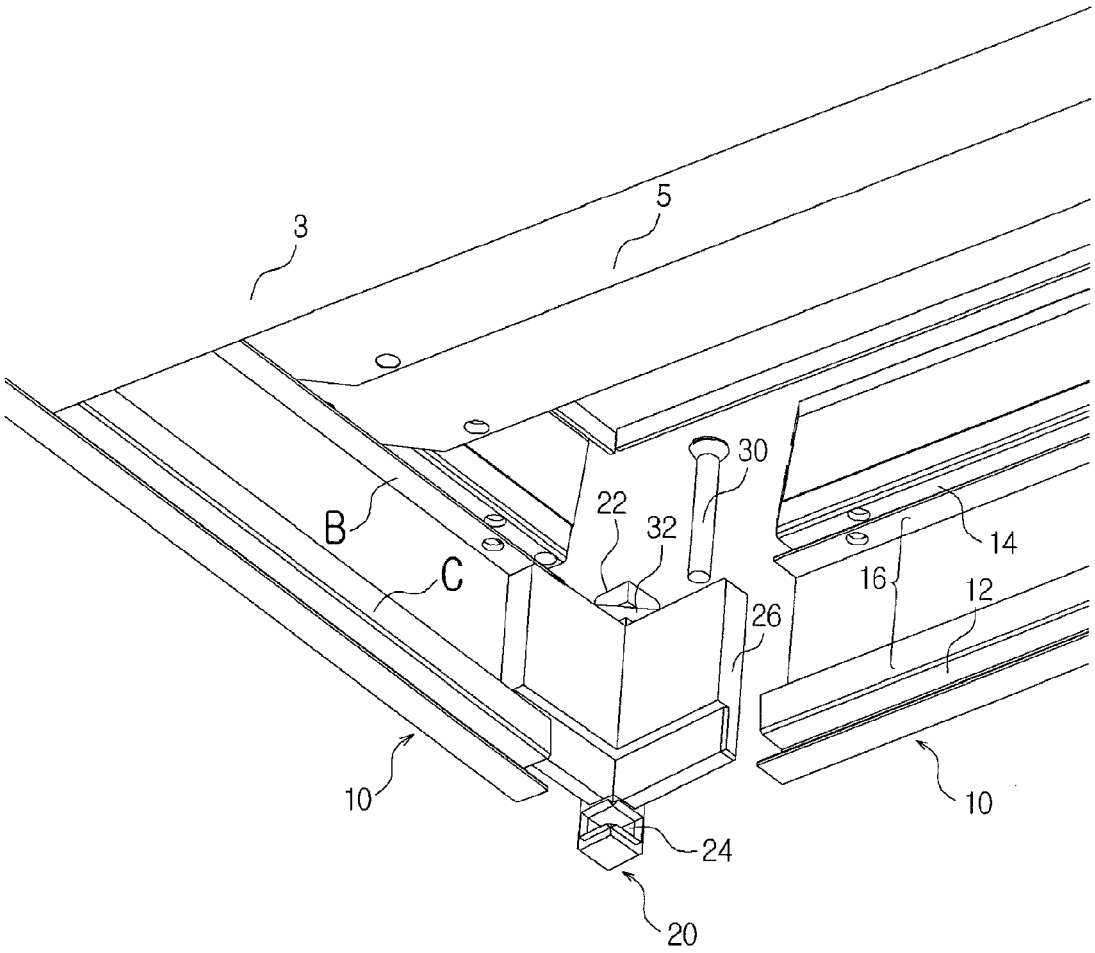
FIG. 3 is an exploded perspective view illustrating an inner side of a joint area of a lighting apparatus frame according to an example embodiment of the present invention.
Figure 4:
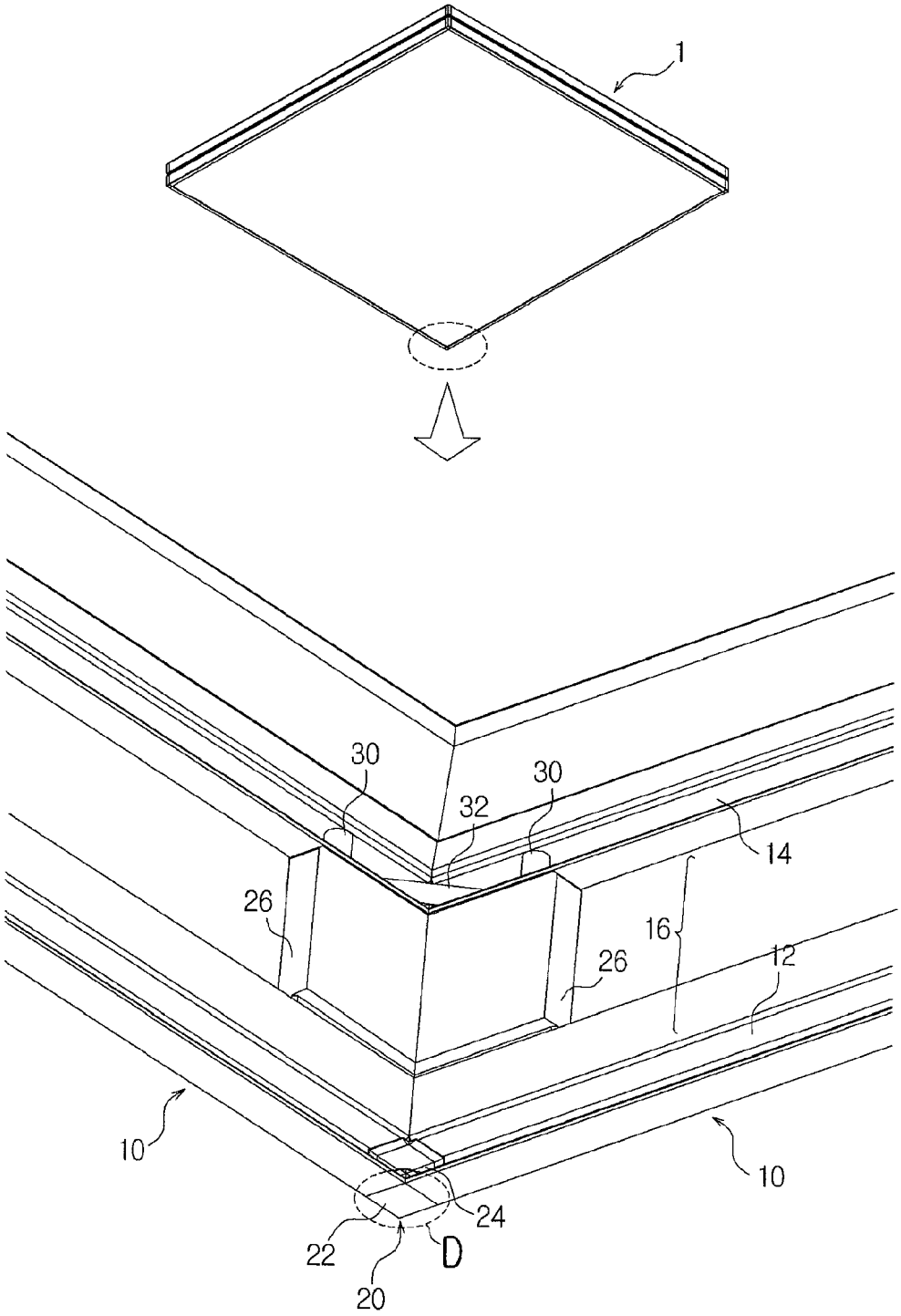
FIG. 4 is a perspective view illustrating an assembled state of FIG. 3.

FIG. 3 is an exploded perspective view illustrating an inner side of a joint area of a lighting apparatus frame according to an example embodiment of the present invention and FIG. 4 is a perspective view illustrating an assembled state of FIG. 3. Referring to FIGS. 3 and 4, a lighting apparatus 1, a lighting plate 3, a substrate 5, a frame member 10, a first groove 12, a second groove 14, a trench 16, the connecting member 20, the body 22, the lighting plate insertion groove 24, the engaging wing 26, a screw 30 and the supporting unit 32 are illustrated.

FIGS. 3 and 4 illustrate an inner side of a frame of the lighting apparatus that is assembled by using the connecting member 20 according to the example embodiment. The body 22 of the connecting member 20 according to the example embodiment is configured to fill up an opening represented as an area D in FIG. 4 (hereinafter, referred to as 'edge portion'), wherein the edge portion is positioned at a joint area between the adjacent frame members 10. Accordingly, the light leakage through the edge portion can be prevented.

In order to shield a gap between the frames, the body 22 may be formed to have a similar shape as the edge portion according to the example embodiment. For example, as shown in FIG. 4, corresponding to a quadratic prism-like shape of the edge portion created by two frame members 10 that are respectively engaged with the connecting member 20, the body 22 can be formed in a quadratic prism-like shape to match and combine with the edge portion. Thus, the edge portion can be effectively shielded by the body 22.

Thus, by manufacturing the connecting member 20 such that the body 22 of the connecting member 20 matches with the edge portion, a light leaking from the edge portion can be effectively blocked.

As described above, the lighting plate insertion groove 24 to which the edge of the lighting plate 3 is inserted is formed on a part of the connecting member 20 so that the light leakage occurring around the edge of the lighting plate 3 can be prevented. Since the lighting plate 3 is inserted to the first groove 12 of the frame member 10, the lighting plate insertion groove 24 may be formed on an extension line of the first groove 12. Thus, according to the example embodiment of the present invention, the lighting plate insertion groove 24 can be connected with the first groove 12 when the frame member 10 is engaged with the connecting member 20.

In this manner, the lighting plate 3 can be mounted on a frame that is formed by connecting the plurality of the frame members 10 with the connecting member 20. A side edge of the lighting plate 3 can be inserted into the first groove 12 of the frame member 10 and a corner of the lighting plate 3 can be inserted into the lighting plate insertion groove 24 of the connecting member 20 so that the lighting plate 3 can be stably supported within the frame and the light leakage at the edge portion may be prevented.

When the lighting plate 3 is formed in a fragile material such as glass or plastic, the edge portion of the lighting plate 3 can be easily damaged during manipulation. To prevent such circumstances, a chamfering process can be performed on an entrance portion of the lighting plate insertion groove 24 so that the edge of the lighting plate 3 may be smoothly inserted to the lighting plate insertion groove 24. In this manner, the lighting plate 3, especially the edge portion thereof, may be prevented from being damaged during the insertion.

In one example embodiment, the entrance portion of the lighting plate insertion groove 24 has a belevled surface (see A in FIG. 1). However, it should be noted that various methods can be applied for chamfering the entrance portion such that the edge portion of the lighting plate 3 can be smoothly introduced within the frame without being damaged. For example, the entrance portion may be chamfered to have a curvature.

The lighting apparatus 1 may have a structure in which the substrate 5 and the lighting plate 3 are spaced apart from each other. To this end, as described above, the first groove 12 for receiving the lighting plate 3 and the second groove 14 for receiving the substrate 5 may be formed within the frame member 10.

Namely, the substrate 5 on which the LED light source is mounted can be placed within the frame by inserting a side edge of the substrate 5 into the second groove 14 formed on the inner surface of the frame member 10. According to the example embodiment, the supporting unit 32 can be positioned at a location where the connecting member 20 is bounded on an edge portion of the substrate 5 of the body 22. Accordingly, the substrate 5 can be securely fixed within the frame and stably supported.

The supporting unit 32 can be formed as a groove similar to the lighting plate insertion groove 24 to receive the edge portion of the substrate 5. Also, the supporting unit 32 may be formed as a support wall or may be formed to include a protrusion corresponding to the shape of the edge portion of the substrate 5. For example, if the edge portion of the substrate 5 is chamfered (see E in FIG. 5), the supporting unit 32 may be formed in a shape that is suitable for supporting the chamfered edge portion of the substrate 5, as illustrated in FIGS. 1 and 2.

Further, as shown in FIG. 4, the supporting unit 32 according to the example embodiment can be formed to allow a part of the supporting unit 32 to be inserted to the second groove 14, thereby improving the bonding between the connecting unit 32 and the frame member 10. When the supporting unit 32 is received in the second groove 14 of the frame member 10, the engaging wing 26 can be matched and combined with the trench 16, which will be further described below. Therefore, the effect of improving the bonding between the connecting member 20 and the frame member 10 can be achieved.

In other words, the connecting member 20 according to the example embodiment is connected to the engaging wing 26 so that the frame members 10 are connected to one another when the frame member 10 is engaged with the engaging wing 26. When the trench 16 is positioned on the frame member 10 so that the engaging wing 26 is inserted to the trench 16, the bonding between the connecting member 20 and the frame member 10 can be improved.

The trench 16 according to the example embodiment is a type of groove formed on the frame member 10 to accommodate the engaging wing 26. In FIGS. 3 and 4, the frame member 10 is formed in a manner such that a step difference between the first groove 12 and the second groove 14 is used to serve as the trench.

In other words, a wall on a first side of the first groove 12 (see C in FIG. 3) that receives the lighting plate 3 and a wall on a second side of the second groove 14 that receives the substrate 5 can form a first and a second walls of the trench 16. Thus, the frame member 10 can be manufactured such that the trench 16 can be provided by using the first groove 12 and the second groove 14, thereby obviating the need to manufacture the trench 16 separately. The engaging wing 25 may be formed to have a certain shape such that an exact match between the engaging wing 25 and the trench 16 is obtained. Accordingly, the connecting member 20 and the lighting apparatus frame according to the example embodiment of the present invention are low cost, easy to manufacture and have enhanced bonding strength.

Thus, by forming the trench 16 on the frame member 10 and designing the engaging wing 26 in correspondence with the trench 16, the engaging wing 26 can be matched and combined with the trench 16. Accordingly, connection between the plurality of the frame members 10 is facilitated. Also, the connected frame members 10 may be prevented from being distorted.

Further, when the engaging wing 26 is matched with the trench 16, the frame member 10 and the engaging wing 26 can be engaged with each other by using, for example, a screw 30 so that the plurality of the frame members 10 are completely coupled to each other to provide a single frame. To this end, a screw hole 28 to which the screw 30 is inserted can be formed by puncturing the engaging wing 26. That is, when the screw hole 28 is coupled to the engaging wing 26 and the screw 30 is coupled to the screw hole 28 by penetrating the frame member 10, the engaging wing 26 and the frame member 10 are engaged with each other.

An opposite side of the connecting member 20 that is not punctured to install the screw hole may have a weak supporting strength for the engaging wing 26 because of a lack of a separate structure for supporting the engaging wing 26. Therefore, as shown in FIGS. 1 and 2, a part of the engaging wing 26 is formed to have a step difference and a groove may be formed on a side wall (see C in FIG. 3) of the first groove 12 in correspondence with the step difference. Thus, the step difference on the engaging wing 26 can be fixed to the groove, thereby improving supporting strength for the engaging wing 26.

Figure 5:
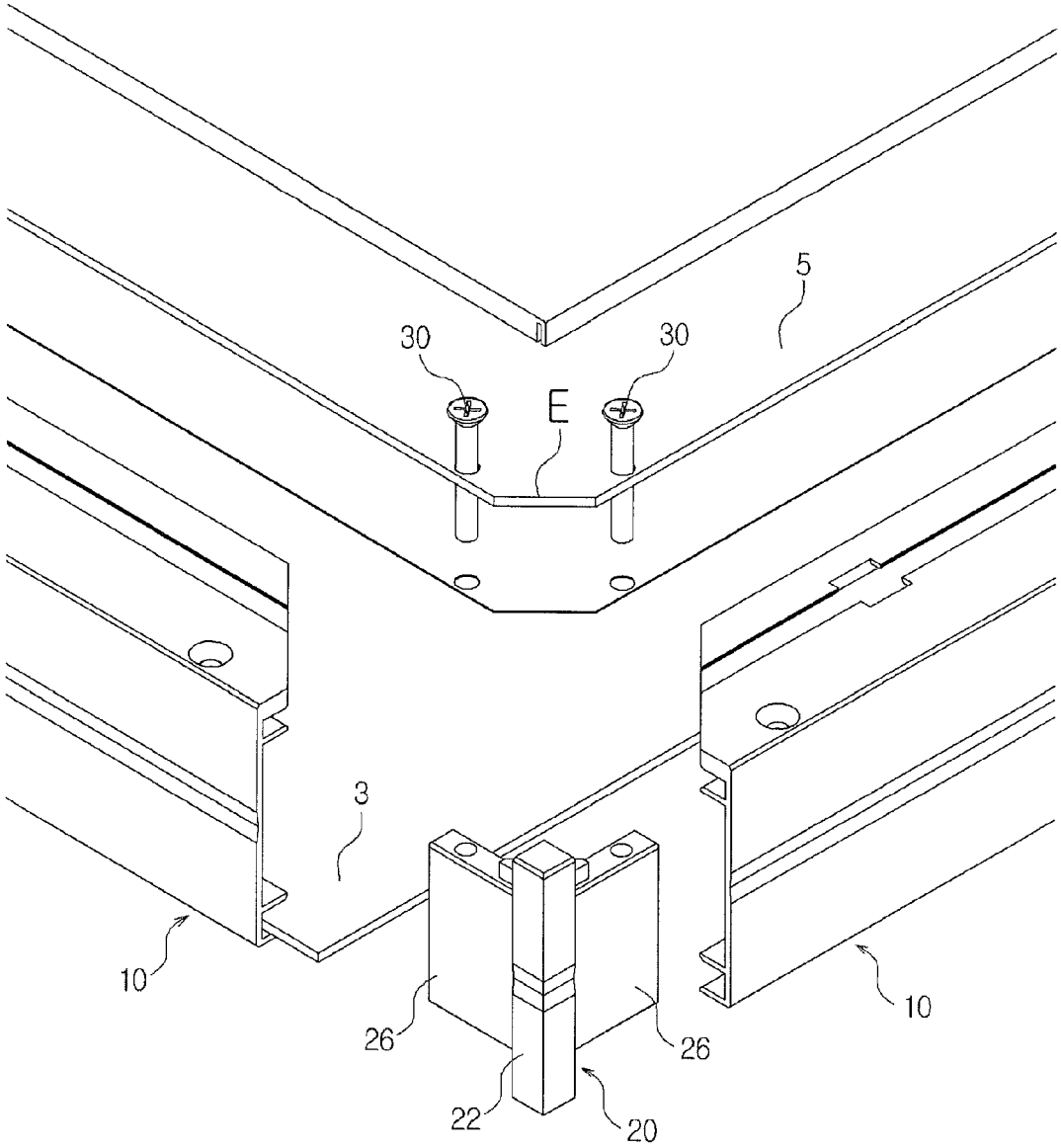
FIG. 5 is an exploded perspective view illustrating an exterior of a lighting apparatus according to an example embodiment of the present invention.

Also, as shown in FIG. 5, the engaging wing 26 may be formed to have a predetermined thickness and the screw hole 28 may be formed thereon. Since the screw 30 is engaged with the engaging wing 26 while penetrating the second groove 14 (or the first groove 12), the bonding between a wall (B in FIG. 3) on one end of the second groove 14 and the engaging wing 26 can be enhanced. For example, as the screw 30 is inserted, a force is exerted to press the wall on one side of the second groove 14 against the engaging wing 26 and a force is exerted to press the engaging wing 26 against the wall on one side of the second groove 14.

Figure 6:
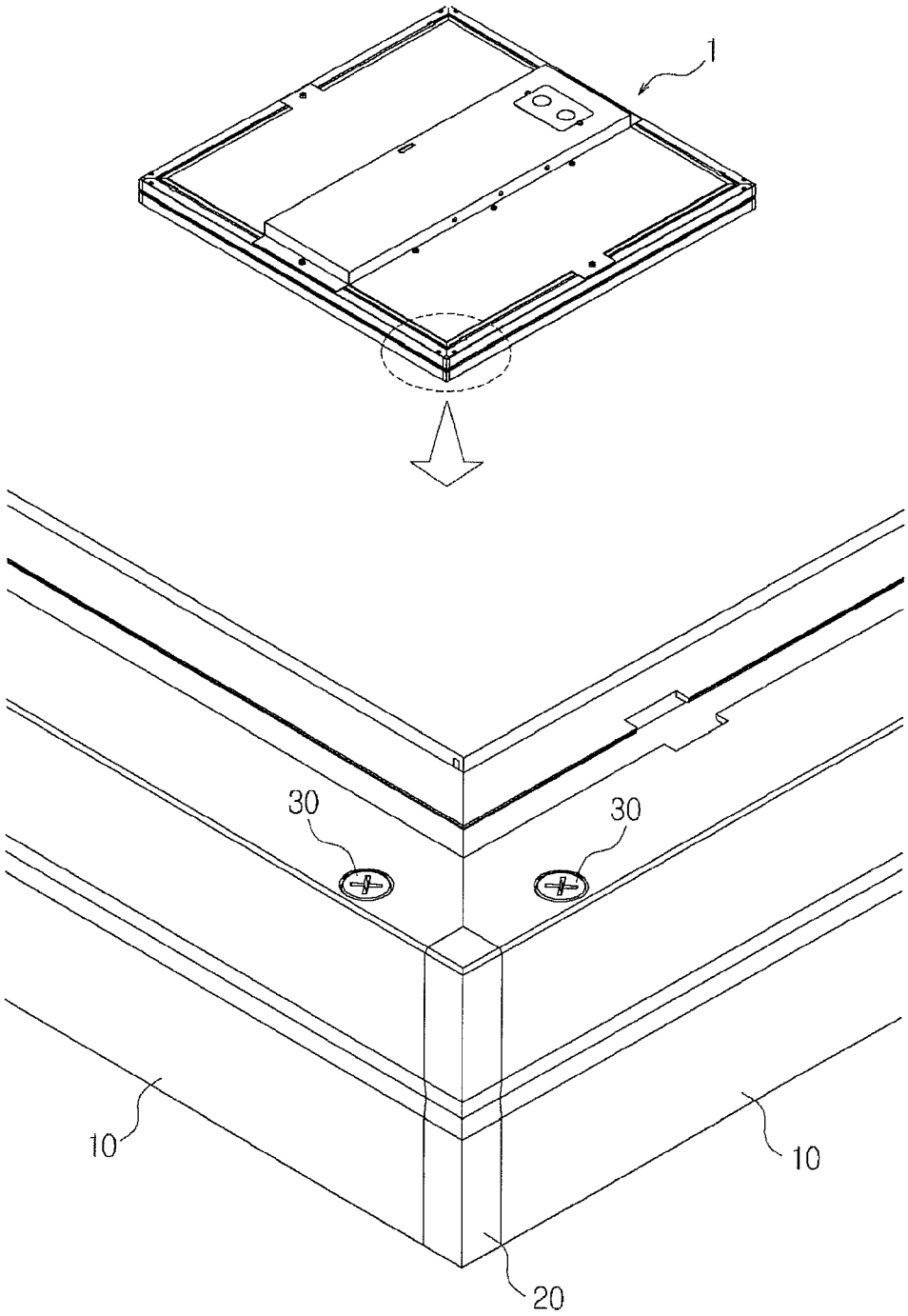
FIG. 6 is a perspective view illustrating an exterior of a lighting apparatus according to an example embodiment of the present invention.

FIG. 5 is an exploded perspective view illustrating an exterior of a lighting apparatus according to an example embodiment of the present invention and FIG. 6 is a perspective view illustrating an exterior of a lighting apparatus according to an example embodiment of the present invention. Referring to FIGS. 5 and 6, the lighting apparatus 1, the lighting plate 3, the substrate 5, the frame member 10, the connecting member 20, the body 22, the engaging wing 26 and the screw 30 are illustrated.

FIGS. 5 and 6 illustrate an exterior of the lighting apparatus 1 in which the frame members are coupled to one another by using the connecting member 20 according to the example embodiment. In the lighting apparatus 1, the substrate 5 on which the LED light source is mounted and the lighting plate 3 are positioned within the frame of the lighting apparatus 1. By using the connecting member 20 at the joint area between the plurality of the frame members 10, the light leakage occurring at the edge portion can be prevented. In addition, the substrate 5 can be reliably supported and the frame members 10 can be securely coupled to one another so that the connected frame members may not be distorted.

In order to mount the lighting plate 3 and the substrate 5 within the lighting apparatus 1 according to the example embodiment, the first groove 12 for receiving the lighting plate 3 and the second groove for receiving the substrate 5 can be positioned within the frame member 10. As already described above, the plurality of the frame members 10 may be securely coupled to one another by using the connecting member 20 according to the example embodiment to provide the frame of the lighting apparatus.

As described above, a light leakage occurring at the edge portion of the lighting apparatus 1 can be prevented by forming the lighting plate insertion groove 24 on the connecting member 20 and inserting the edge portion of the lighting plate 3 into the lighting plate insertion groove 24. Also, the supporting unit 32 can be arranged in a position where the connecting member 20 is bounded on the edge portion of the substrate 5 so that the substrate 5 may not be shaken but stably supported. Further, by forming the trench 16 on the inner side of the frame member 10 such that the engaging wing 26 may be matched and combined with the trench 16, the bonding between the connecting member 20 and the frame member 10 can be improved. Accordingly, the frame member 10 may be prevented from being distorted due to mismatch between the connecting member 20 and the frame member 10.

In one example embodiment, the lighting apparatus may be configured to have a lateral type structure in which a light guide plate that is used for the light source module includes the LED light source positioned on a side surface thereof. In this case, the light guide plate may be received within the frame of the lighting apparatus and the LED light source may be positioned on the side surface of the light guide plate to serve as the light source module.

When the lighting apparatus has the lateral type structure, a protection plate may be used as the lighting plate instead of a diffusion plate. In this case, the same effect as described above can be obtained. That is, by using the connecting member at the joint between the plurality of the frame members, the light leakage occurring at the edge portion can be prevented. In addition, the substrate can be reliably supported and the frame member can be securely coupled to one another so that the frame member may not be distorted.

As described above, the light leakage occurring at the edge portion of the lighting apparatus can be prevented by forming a lighting plate insertion groove on the connecting member and inserting the edge of the lighting plate thereto. Also, the substrate can be held in place and stably supported by positioning the supporting unit at a location where the connecting member is bounded on the light guide plate.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A frame connecting member connecting a plurality of frame members to provide a frame of a lighting apparatus, the frame connecting member comprising:

a body;

an engaging unit connected to the body, the engaging unit being configured to be coupled to the plurality of the frame members, respectively wherein the engaging unit has a shape of an engaging wing that extends from at least one of a first side and a second side of the body wherein the engaging wing is configured to have a certain thickness such that a screw hole is positioned thereon and the engaging wing is coupled to the frame member by using a screw that penetrates the frame member and engages with the screw hole; and a light leakage prevention unit connected to the body, the light leakage prevention unit being configured to prevent a light emitted from the lighting apparatus from leaking.

2. The frame connecting member according to claim 1, wherein the body is positioned at an edge portion where the plurality of the frame members contact each other.

3. The frame connecting member according to claim 2, wherein the body is configured to have a shape such that the body is matched with the edge portion to shield a light leaking from the edge portion.

4. The frame connecting member according to claim 1, wherein the engaging wing is configured to have a shape such that the engaging wing matches with a trench provided on the frame member.

5. The frame connecting member according to claim 1, wherein a first groove is positioned on an inner surface of the frame member to receive a lighting plate and the light leakage prevention unit is formed as a lighting plate insertion groove embedded in a part of the body to receive a part of the lighting plate.

6. The frame connecting member according to claim 5, wherein the lighting plate insertion groove has an entrance portion that is chamfered to facilitate an insertion of the lighting plate to the lighting plate insertion groove.

7. The frame connecting member according to claim 5, wherein the lighting plate insertion groove receives the lighting plate which is a diffuser or a protector.

8. The frame connecting member according to claim 5, wherein a supporting unit is provided in the body to support a light source module which is mounted within the frame and spaced apart from the lighting plate by a predetermined distance, the supporting unit being positioned in correspondence with the light source module.

9. The frame connecting member according to claim 8, wherein the supporting unit is configured to be inserted to a second groove which is positioned on each of the plurality of the frame members to receive the light source module.

10. The frame connecting member according to claim 9, wherein the engaging unit matches with a trench having a certain shape and positioned on the frame member, the trench being provided by forming the first groove and the second groove and positioned between the first groove and the second groove.

11. The frame connecting member according to claim 8, wherein the supporting unit of the body supports the light source module which is a substrate on which a light emitted diode (LED) light source is mounted or a light guide plate having a side surface on which the LED light source is positioned.

12. The frame connecting member according to claim 1, wherein the body, the engaging unit and the light leakage prevention unit are integrally formed with one another by using a die casting method.

13. A light emitting diode (LED) lighting apparatus comprising:

a light source module;

a lighting plate spaced apart from the light source module by a predetermined distance;

a frame member including a first groove receiving the lighting plate and a second groove receiving the light source module, wherein a plurality of the frame members are connected to one another to provide a lighting apparatus frame that receives the lighting plate and the light source module therein; and a frame connecting member connecting the plurality of the frame members, the frame connecting member comprising, a body;

an engaging unit connected to the body, the engaging unit being coupled to the plurality of the frame members, respectively, wherein the engaging unit has a shape of an engaging wing that extends from at least one of a first side and a second side of the body wherein the engaging wing is configured to have a certain thickness such that a screw hole is positioned thereon and the engaging wing is coupled to the frame member by using a screw that penetrates the frame member and engages with the screw hole; and a light leakage prevention unit connected to the body, the light leakage prevention unit being configured to prevent a light emitted from the LED lighting apparatus from leaking.

14. The LED lighting apparatus according to claim 13, wherein the body is configured to have a shape such that the body is matched with an edge portion positioned in a location where the plurality of the frame members contact each other to shield a light leaking from the edge portion.

15. The LED lighting apparatus according to claim 13, wherein a trench is provided on the frame member, which is provided by forming the first groove and the second groove, the trench being positioned between the first groove and the second groove.

16. A light emitting diode (LED) lighting apparatus comprising:

a light source module;

a lighting plate configured to be positioned spaced apart from the light source module by a predetermined distance;

a frame member including a first groove for receiving the lighting plate and a second groove for receiving the light source module, wherein a plurality of the frame members are connected to one another to provide a lighting apparatus frame that receives the lighting plate and the light source module therein;

a frame connecting member for connecting the plurality of the frame members, the frame connecting member comprising, a body;

an engaging unit connected to the body, the engaging unit being configured to be coupled to the plurality of the frame members, respectively;

a light leakage prevention unit connected to the body, the light leakage prevention unit being configured to prevent a light emitted from the LED lighting apparatus from leaking; and a supporting unit provided in the body to support the light source module, the supporting unit being inserted to the second groove and positioned in correspondence with the light source module, wherein the body is configured to have a shape such that the body is matched with an edge portion positioned in a location where the plurality of the frame members contact each other to shield a light leaking from the edge portion, wherein the engaging unit has a shape of an engaging wing that extends from at least one of a first side and a second side of the body, wherein a trench is provided on the frame member and the engaging wing is configured to have a shape such that the engaging wing matches with the trench, wherein the trench is configured to be provided by forming the first groove and the second groove, the trench being positioned between the first groove and the second groove, wherein the engaging wing is configured to have a certain thickness such that a screw hole is positioned thereon, and the engaging wing is coupled to the frame member by using a screw that penetrates the frame member to engage with the screw hole, wherein the light leakage prevention unit is formed as a lighting plate insertion groove embedded in a part of the body to receive a part of the lighting plate, and wherein the lighting plate insertion groove has an entrance portion that is chamfered to facilitate an insertion of the lighting plate to the lighting plate insertion groove.

* * * * *